US005749345A

United States Patent [19]

Treml

[11] Patent Number: 5,749,345

[45] Date of Patent: May 12, 1998

[54] FUEL SYSTEM

[75] Inventor: Christian Treml, Munich, Germany

[73] Assignee: Bayerische Motoren Werke Aktiengesellschaft

[21] Appl. No.: 743,612

[22] Filed: Nov. 4, 1996

[30] Foreign Application Priority Data

Nov. 2, 1995 [DE] Germany ..... 195 40 892.6

[51] Int. Cl.[6] ..... F02M 41/00

[52] U.S. Cl. ..... 123/456; 123/457; 123/514

[58] Field of Search ..... 123/510, 511, 123/514, 457, 459, 463, 456, 497

[56] References Cited

U.S. PATENT DOCUMENTS

| | | | |
|---|---|---|---|
| 4,926,829 | 5/1990 | Tuckey | 123/514 |
| 5,148,792 | 9/1992 | Tuckey | 123/514 |
| 5,195,494 | 3/1993 | Tuckey . | |
| 5,197,436 | 3/1993 | Ozawa . | |
| 5,289,810 | 3/1994 | Bauer et al. | 123/514 |
| 5,361,742 | 11/1994 | Briggs et al. | 123/514 |
| 5,390,643 | 2/1995 | Sekine | 123/514 |
| 5,421,306 | 6/1995 | Talaski | 123/510 |
| 5,425,342 | 6/1995 | Ariga et al. | 123/514 |
| 5,505,181 | 4/1996 | McRae et al. | 123/511 |
| 5,603,302 | 2/1997 | Minagawa et al. | 123/510 |

FOREIGN PATENT DOCUMENTS

| | | |
|---|---|---|
| 0186441A1 | 7/1986 | European Pat. Off. . |
| 0678664A2 | 10/1995 | European Pat. Off. . |
| 3914939A1 | 11/1990 | Germany . |
| 4136833A1 | 5/1993 | Germany . |
| 4231731A1 | 7/1993 | Germany . |
| 4224981A1 | 2/1994 | Germany . |
| 440045A1 | 7/1994 | Germany . |
| 4402224A1 | 7/1995 | Germany . |

OTHER PUBLICATIONS

Patent Abstracts of Japan, M-1432, Jun. 18, 1993, vol.17/ No. 322, Feb. 9, 1973, Appl. No. 3-192290, Accumulator Fuel Injection Device.

Search Report, Feb. 12, 1997, Europe.

*Primary Examiner*—Thomas N. Moulis

*Attorney, Agent, or Firm*—Evenson McKeown Edwards & Lenahan, PLLC

[57] ABSTRACT

A pressurized fuel system for a motor vehicle is provided with a pressure regulator which opens above a predetermined limit pressure so that the not required fuel can flow by way of a return flow pipe into the fuel tank. Behind the pressure regulator, a check valve is connected in the direction of the engine.

24 Claims, 3 Drawing Sheets

FUEL SYSTEM

BACKGROUND AND SUMMARY OF THE INVENTION

This invention relates to a fuel system for a motor vehicle having a fuel tank with a fuel pump arranged therein which delivers fuel through a forward flow pipe by way of a filter into an injection strip of an engine, and having a return flow pipe through which the fuel not required by the engine flows back into the fuel tank.

A fuel system for a motor vehicle is known in which a three/two-way valve is used for controlling the fuel circulation. This valve requires a relatively large space and is expensive.

It is an object of the invention to provide a fuel system for a motor vehicle in which simple mechanical components are used and which requires little space. In particular, the new fuel system is to be usable for a running-loss fuel circulation.

In the case of a fuel system for a motor vehicle of the above-mentioned type, this object is achieved according to preferred embodiments of the present invention by providing an arrangement wherein the fuel acts upon a pressure regulator which opens above a predetermined limit pressure so that the not required fuel can flow by way of a return flow pipe into the fuel tank, and wherein a check valve is connected behind the pressure regulator in the direction of the engine.

The used components have a simple construction and can be integrated in a single assembly; this applies particularly to a check valve, a pressure regulator and optionally a filter. As the result of the arrangement of these components close to the tank and because of the existing elasticities, an unacceptably high pressure is avoided. As a safety measure, pressure buffers in the form of elastic elements are installed particularly in the pipes.

In a fuel system, a special problem may occur because of the "afterheating" of a hot fuel supply system when the engine is stopped. When the system pressure remains approximately the same, the fuel which expands as a result of the high temperature and which is situated in the pipes between the fuel pump and the pressure regulator is discharged approximately without pressure into the return flow pipe by way of the pressure regulator until a maximal temperature is reached. Then the pressure continuously decreases in the system whereby the still very hot fuel is exhaled. The gas bubbles formed in the injection strip will then result in hot-starting problems.

In certain preferred embodiments of the fuel system according to the invention, the formation of gas bubbles during the afterheating phase is prevented by a check valve in the forward flow pipe. During the afterheating phase, the pressure in the injection strip will rise above the system pressure so that almost no fuel will be exhaled. By means of the engine-side pressure limiting valve, a good system filling is achieved on the one hand and, on the other hand, a protection from unacceptably high pressures in the afterheating phase is achieved.

The integration of the components, such as the pressure regulators, the filter, the check valve, the pressure limiting valve and/or the pressure accumulator, in a valve block or other assembly reduces the space requirement. As a result, an arrangement of the valve block or of the assembly close to the tank is also conceivable. The housing of the valve block or of the assembly can consist of metal or plastic. Particularly the construction of the housing as a molded part was found to be reasonable with respect to cost.

In the case of the injection strip, the outlet to the engine-side return flow pipe is preferably constructed at the highest point. This has the advantage that gas which is situated in the injection strip can be discharged completely by way of the return flow pipe into the tank.

When there is an "overmounted" bearing of the valve block in the forward flow and return flow pipe, the noise is reduced. The overmounted bearing is characterized in that additional fastening elements are saved and possible resonance sounds of the pressure regulator are not transmitted to the vehicle body.

Because of the simple construction of the fuel system, it can be used universally, thereby reducing variants. The raising of the pressure in the injection strip in the afterheating phase of the engine stoppage has the result that the hot start can be controlled also without any flushing with cold fuel from the tank. The fuel system according to the invention has improved operating conditions when a sucking jet pump is used because the temperature level in the pipes and in the fuel tank is reduced so that fewer gas constituents are present in the fuel. In this manner, the sucking jet pump will deliver better so that the power of the sucking jet pump and of the fuel pump can be reduced. The reduced demands on the pump capacity and the hot delivery permit the use of low-cost single-stage pumps or flow pumps. A retrofitting of used vehicles is also conceivable.

As a result of a reduction of the gurgling noise of the sucking jet pump after a hot start and the use of the overmounted bearing of the valve bock in the forward flow and return flow pipes, the fuel system according to the invention operates more quietly than known fuel systems while the costs are clearly lower. Finally, the used components are less easily soiled.

Other objects, advantages and novel features of the present invention will become apparent from the following detailed description of the invention when considered in conjunction with the accompanying drawings.

BRIEF DESCRIPTION OF THE DRAWINGS

Figure 1:
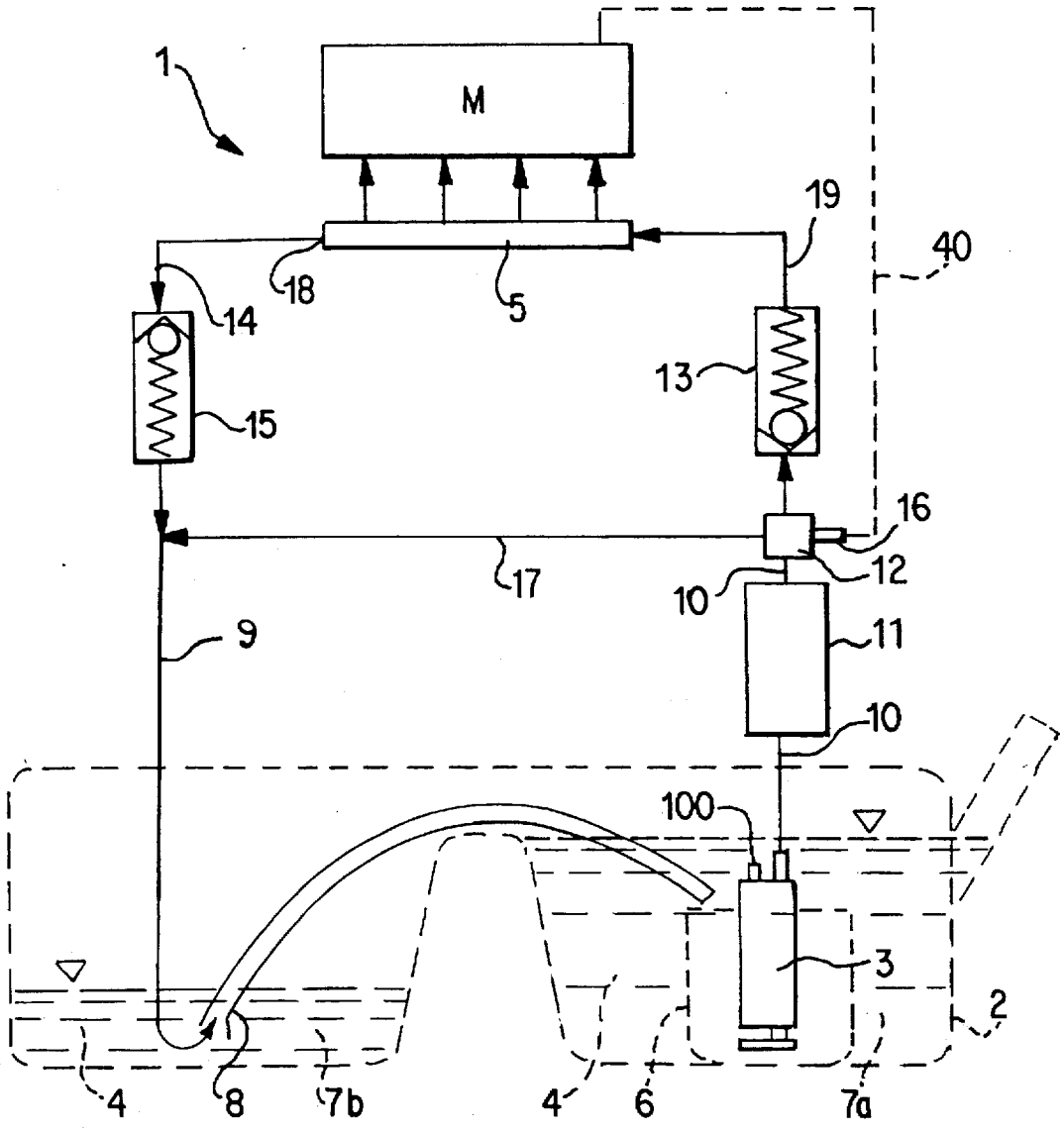
FIG. 1 is a schematic diagram of a first embodiment of a fuel system with an additional engine-side return flow pipe, constructed according to a first preferred embodiment of the present invention.

FIG. 1 illustrates a fuel system 1 in which fuel 4 is delivered from a fuel tank 2 by way of a fuel pump 3 to an injection strip 5 of an engine M which is not shown in detail. As a rule, the fuel pump 3 is driven electrically and is situated in a splash pot 6. The fuel tank 2 illustrated in FIG. 1 has two chambers 7*a* and 7*b*. The fuel level in the two chambers differs, as characterized in each case by a triangle standing on its vertex.

In the embodiment of FIG. 1, the fuel is delivered by means of a sucking jet pump 8 from the left chamber 7*b* into the right chamber 7*a*. The sucking jet pump 8 is supplied by the amount of fuel which is not required by the engine M and which flows back into the fuel tank 2. In the case of a one-part fuel tank, the sucking jet pump 8 is eliminated so that the returning fuel flows by way of a return flow pipe 9 directly into the fuel tank.

The fuel delivered from the fuel tank 2 by the fuel pump 3 flows to a filter 11 by way of a forward flow pipe 10. The filtered fuel acts upon a pressure regulator 12 and then flows through a pressure maintaining or check valve 13. Then the fuel reaches the injection strip 5. The fuel not required by the engine M returns by way of the return flow pipe 17 or 9 into the fuel tank 2.

During the engine operation, the engine-side pressure limiting valve 15 is closed. The pressure limiting valve 15 is activated only during a filling of the system and possibly during the afterheating phase when the engine is stopped. The opening pressure of the additional pressure limiting valve 15, on the one hand, is higher than the system pressure but, on the other hand, lower than the opening pressure of the pump-side pressure limiting valve 100. The system filling clearly takes place more rapidly by means of an excess pressure acting upon a vacuum connection of the pressure regulator 12 while the fuel pump 3 is operated simultaneously.

Since the opening pressure of the engine-side pressure limiting valve 15 is higher than the system pressure, the formation of gas bubbles during the afterheating phase is largely prevented. It is a prerequisite that the injection valves of the injection strip 5 are tight. The engine-side pressure limiting valve 15 protects against unacceptably high pressures in the afterheating phase. When the fuel in the injection strip 5 reaches an unacceptably high pressure, the pressure limiting valve 15 is opened and the excess fuel can flow back into the fuel tank 2 by way of the return flow pipes 14 and 9.

The fuel pump 3 transports a constant amount of fuel through the forward flow pipe 10. By means of the pressure regulator 12, the quantity of fuel not required by the engine is delivered by way of a return flow pipe 17 to the return flow pipe 9.

On the injection strip 5, an outlet opening 18 is preferably constructed on the highest point of the injection strip 5. As a result, it is achieved that the gas situated in the injection strip 5 can be transported completely back to the fuel tank 2.

Figure 2:
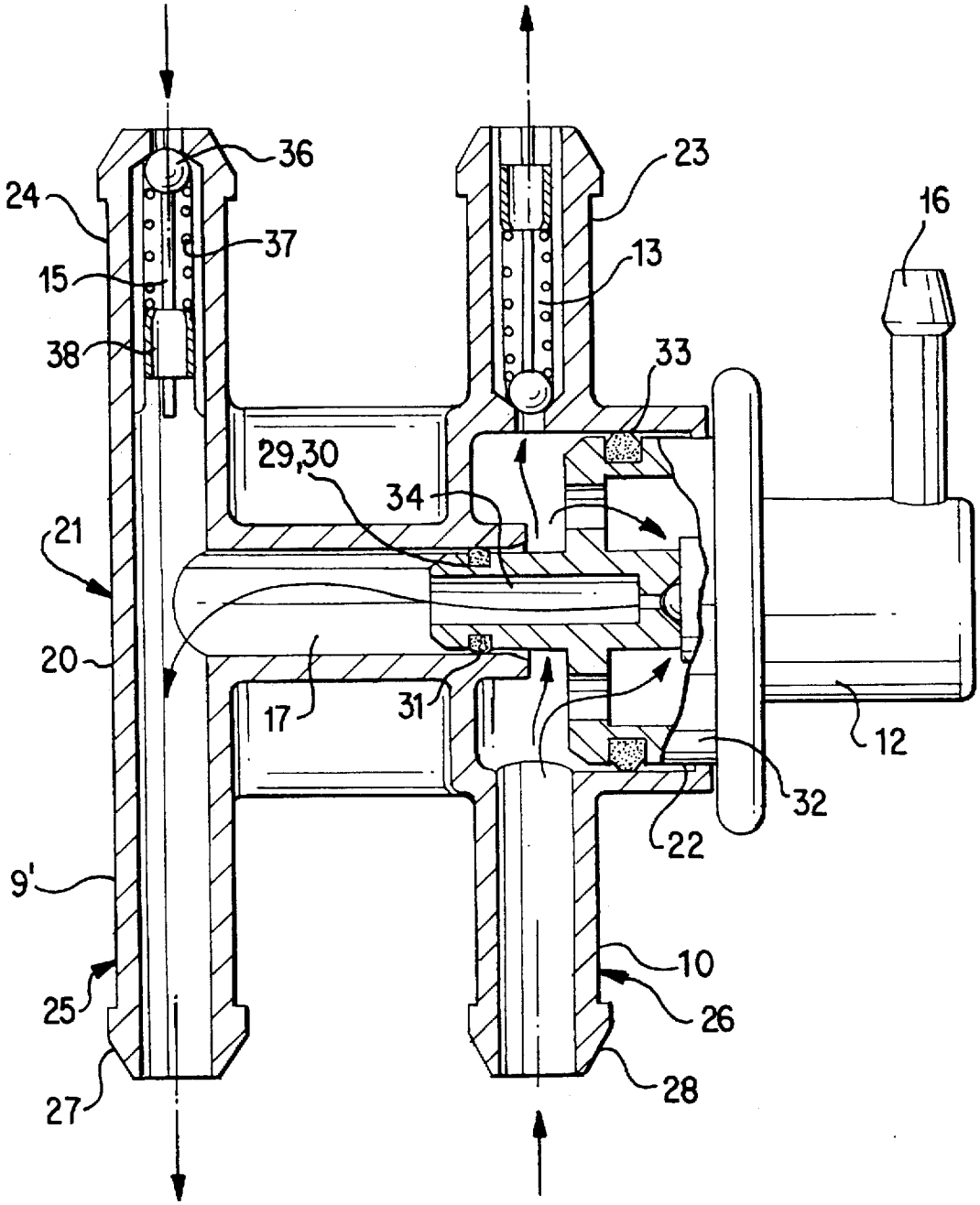
FIG. 2 is a sectional view of a valve block in which an engine-side check valve and an engine-side pressure limiting valve as well as a pressure regulator are integrated, constructed according to a preferred embodiment of the present invention.

FIG. 2 shows a valve block 20 in which the engine-side check valve 13 and the engine-side pressure limiting valve 15 are integrated. The valve block 20 has a housing 21 which may be made of metal or plastic. In the housing 21, a connection opening 22 for the pressure regulator 12 is constructed. The housing 21 has an H-shape. The arrows in FIG. 2 show the flowing direction of the fuel. In the left upper section 24 of the housing 21, which leads to the return flow pipe 14, the engine-side pressure limiting valve 15 is arranged. The check valve 13 is installed in the respective opposite section 23. Below the sections 23 and 24 constructed as pipes, a connection pipe 17 is provided which connects the return flow pipe consisting of the sections 9' and 24 with the forward flow pipe 26 of the housing 21 which consists of sections 10 and 23.

At the ends 27 and 28 of the pipes 25 and 26 of the housing 21 pointing to the outside, thickenings with a conical cross-section are constructed which reduce their cross-section in the axial direction toward the outside. In another embodiment, the ends 27 and 28 may have a pine-cone-shaped cross-section.

In the connection opening 22, which is constructed in the forward flow pipe 26 of the housing 21, a connection piece 29 of the pressure regulator 12 is arranged. The connection piece 29 has a cylindrical section 30 with a diameter adapted to the inside diameter of the return flow pipe 17. On its outer circumference, a seal 31, such as an O-ring, is provided. The cylindrical section 30 is adjoined by another cylindrical section 32 with a larger diameter. A seal 33 is also arranged on the outer circumference of the cylindrical section 32.

In the pressure regulator 12, a diaphragm, which is not shown, or another device is provided which opens above a certain limit pressure, for example, between 3 and 4 bar, so that the fuel can flow out of the forward flow pipe 26 through a passage opening 34 constructed in the cylindrical sections 30 and 32. The fuel flowing through the passage opening 34 is represented by the essentially horizontally extending arrow in FIG. 2.

As illustrated in FIGS. 1 and 2, the check valve 13 and the pressure limiting valve 15 essentially consist of a closing element 36, such as a ball, a resilient element 37 and a spring retention 38.

Figure 3:
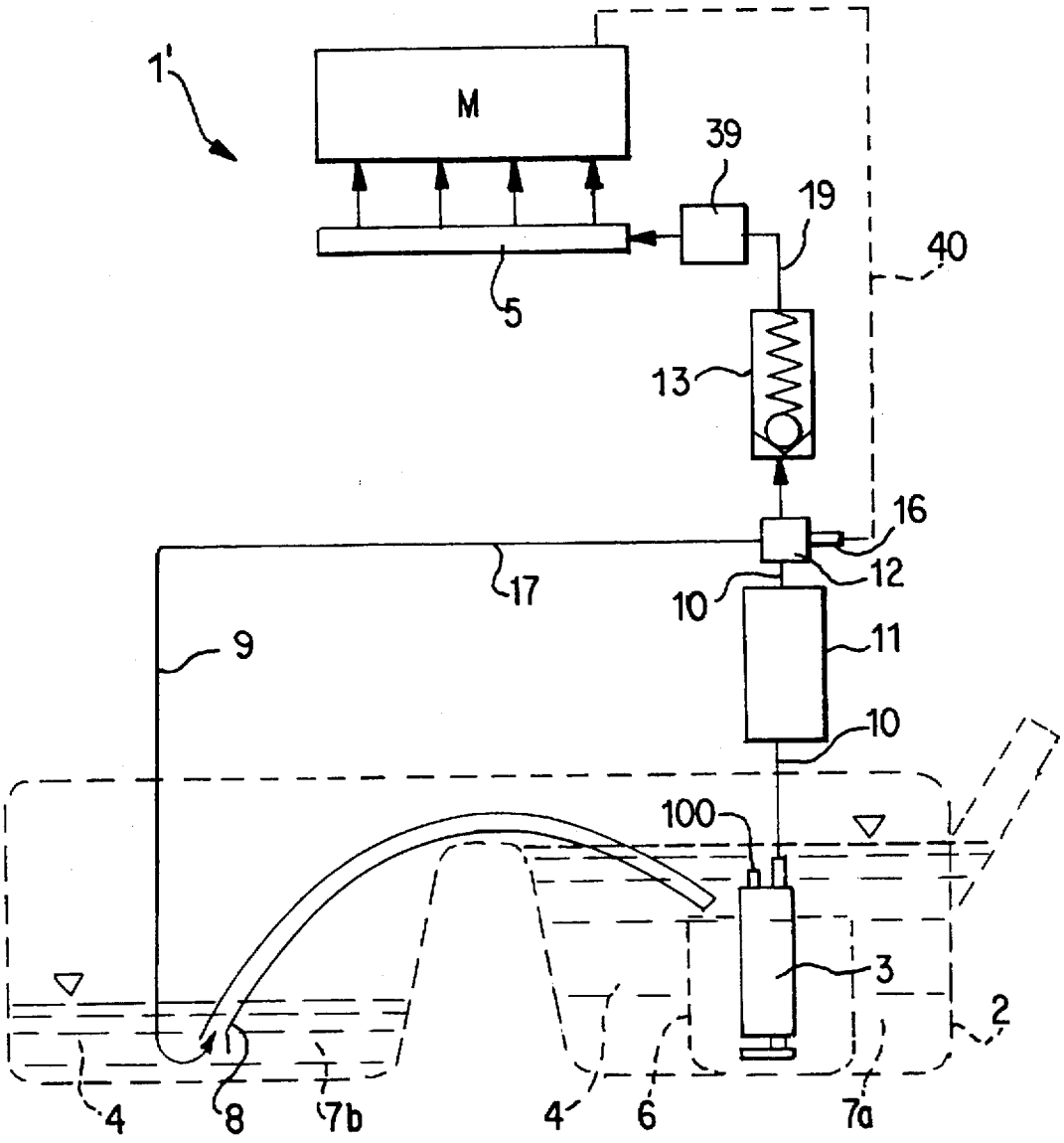
FIG. 3 is a schematic diagram of a fuel system without any engine-side return flow pipe, constructed according to a second preferred embodiment of the present invention.

FIG. 3 shows a second embodiment of a fuel system 1' in which, in contrast to the embodiment of FIGS. 1 and 2, the engine-side pressure limiting valve 15 is left out. Correspondingly, the engine-side return flow pipe 14 and the outlet opening 18 on the injection strip 5 are also absent. An elastic element 39 was added which may be constructed, for example, in the form of a pressure accumulator. As in FIG. 1, a vacuum pipe 40 may be provided between the suction pipe of the engine M and the pressure regulator 12.

As found in tests, a system filling of the still empty pipes and assemblies before the first-time operation is also conceivable without any flushing. This is achieved by the fact that pressure peaks are reduced by means of the existing elasticity in the forward flow pipe 19. As a protection against pressures not occurring in the normal operation, one or several elastic elements 39 are installed in the forward flow pipe 19.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Fuel system for a motor vehicle having a fuel tank with a fuel pump arranged therein which delivers fuel through a forward flow pipe by way of a filter into an injection strip of an engine, and having a return flow pipe through which the fuel not required by the engine flows back into the fuel tank, wherein the fuel acts upon a pressure regulator which opens above a predetermined limit pressure so that the not required fuel can flow by way of a return flow pipe into the fuel tank, wherein a check valve is connected downstream of the pressure regulator in the direction of the engine, wherein a further return flow pipe is connected on the engine side with the injection strip and leads to a pressure limiting valve, wherein the pressure limiting valve is connected to the return flow pipe on the respective opposite outlet side, and wherein the valves used in the fuel system, and the pressure regulator are integrated in one component.

2. Fuel system according to claim 1, wherein a further return flow pipe is connected on the engine side with the injection strip and leads to a pressure limiting valve, and wherein the pressure limiting valve is connected to the return flow pipes on the respective opposite outlet side.

3. Fuel system according to claim 1, wherein the one component is a valve block which has a housing which consists of a forward flow pipe, a return flow pipe and a pipe connecting the two pipes and, the check valve being installed in the forward flow pipe and the pressure limiting valve being installed in the return flow pipe.

4. Fuel system according to claim 3, wherein the housing of the valve block has a connection for the pressure regulator.

5. Fuel system according to claim 1, wherein the opening pressure of the engine-side pressure limiting valve, on the one hand, is higher than the system pressure and, on the other hand, is lower than the opening pressure of a pump-side pressure limiting valve.

6. Fuel system according to claim 2, wherein the opening pressure of the engine-side pressure limiting valve, on the one hand, is higher than the system pressure and, on the other hand, is lower than the opening pressure of a pump-side pressure limiting valve.

7. Fuel system according to claim 3, wherein the opening pressure of the engine-side pressure limiting valve, on the one hand, is higher than the system pressure and, on the other hand, is lower than the opening pressure of a pump-side pressure limiting valve.

8. Fuel system according to claim 1, wherein the engine-side pressure limiting valve is closed during the operation of the engine and is opened only during a system filling or at a corresponding pressure during the afterheating phase when the engine is stopped.

9. Fuel system according to claim 2, wherein the engine-side pressure limiting valve is closed during the operation of the engine and is opened only during a system filling or at a corresponding pressure during the afterheating phase when the engine is stopped.

10. Fuel system according to claim 3, wherein the engine-side pressure limiting valve is closed during the operation of the engine and is opened only during a system filling or at a corresponding pressure during the afterheating phase when the engine is stopped.

11. Fuel system according to claim 5, wherein the engine-side pressure limiting valve is closed during the operation of the engine and is opened only during a system filling or at a corresponding pressure during the afterheating phase when the engine is stopped.

12. Fuel system according to claim 3, wherein the valve block is arranged in the fuel tank.

13. Fuel system according to claim 3, wherein the valve block is arranged on the fuel tank.

14. Fuel system according to claim 4, comprising a fuel filter interposed between the fuel pump and the pressure regulator.

15. Fuel system according to claim 12, comprising a fuel filter interposed between the fuel pump and the pressure regulator, said filter being integrated into said one component.

16. Fuel system according to claim 4, comprising a fuel filter interposed between the fuel pump and the pressure regulator, said filter being integrated into said one component.

17. Motor vehicle fuel supply system comprising:

a fuel tank, a fuel injection strip, a fuel pump which delivers fuel under pressure from the fuel tank to the fuel injection strip, a return flow pipe leading to the fuel tank, a pressure regulator interposed between the fuel pump and the fuel injection strip which opens above a predetermined limit pressure so that not required fuel flows by way of the return flow pipe into the fuel tank, and a check valve connected between the pressure regulator and the injection strip, wherein the valves used in the fuel system, and the pressure regulator are integrated in one component.

18. Motor vehicle fuel supply system according to claim 17, wherein a further return flow pipe is connected on the engine side with the injection strip and leads to a pressure limiting valve, and wherein the pressure limiting valve is connected to the return flow pipes on the respective opposite outlet side.

19. Motor vehicle fuel supply system according to claim 18, wherein the one component is a valve block which has a housing which consists of a forward flow pipe, a return flow pipe and a pipe connecting the two pipes, the check valve being installed in the forward flow pipe and the pressure limiting valve being installed in the return flow pipe.

20. Fuel system for a motor vehicle having a fuel tank with a fuel pump arranged therein which delivers fuel through a forward flow pipe by way of a filter into an injection strip of an engine, and having a return flow pipe through which the fuel not required by the engine flows back into the fuel tank, wherein the fuel acts upon a pressure regulator which opens above a predetermined limit pressure so that the not required fuel can flow by way of a return flow pipe into the fuel tank, wherein a check valve is connected downstream of the pressure regulator in the direction of the engine, wherein a further return flow pipe is connected on the engine side with the injection strip and leads to a pressure limiting valve, wherein the pressure limiting valve is connected to the return flow pipe on the respective opposite outlet side, and wherein the engine-side pressure limiting valve is closed during the operation of the engine and is opened only during a system filling or at a corresponding pressure during the afterheating phase when the engine is stopped.

21. Fuel system according to claim 20, wherein at least one elastic element is installed as a pressure buffer in the forward flow pipe.

22. Fuel system according to claim 20, wherein the one component is a valve block which has a housing which consists of a forward flow pipe, a return flow pipe and a pipe connecting the two pipes and, the check valve being installed in the forward flow pipe and the pressure limiting valve being installed in the return flow pipe, and wherein the housing of the valve block has a connection for the pressure regulator.

23. Fuel system according to claim 20, wherein the one component is a valve block which has a housing which consists of a forward flow pipe, a return flow pipe and a pipe connecting the two pipes and, the check valve being installed in the forward flow pipe and the pressure limiting valve being installed in the return flow pipe, and wherein the valve block is arranged in the fuel tank.

24. Fuel system according to claim 20, wherein the one component is a valve block which has a housing which consists of a forward flow pipe, a return flow pipe and a pipe connecting the two pipes and, the check valve being installed in the forward flow pipe and the pressure limiting valve being installed in the return flow pipe, and wherein the valve block is arranged on the fuel tank.

* * * * *